US005353977A

United States Patent [19]

Schiro, Jr. et al.

[11] Patent Number: 5,353,977

[45] Date of Patent: Oct. 11, 1994

[54] UMBRELLA HOLSTER

[76] Inventors: Frank P. Schiro, Jr.; Patricia T. Schiro, both of 9134 Teal St., Bay St. Louis, Miss. 39520-7110

[21] Appl. No.: 179,675

[22] Filed: Jan. 11, 1994

[51] Int. Cl.[5] ..... A45F 5/00

[52] U.S. Cl. ..... 224/251; 135/16

[58] Field of Search ..... 135/16, 98, 99, 107, 135/108, 19; 224/204, 206, 209, 215, 216, 225, 251, 259; 403/377, 109; 248/188.9

[56] References Cited

U.S. PATENT DOCUMENTS

| | | | |
|---|---|---|---|
| 1,460,821 | 7/1923 | Morris . | |
| 2,994,152 | 8/1961 | Donahue | 248/188.9 |
| 3,089,143 | 5/1963 | Jacobson | 224/259 X |
| 3,199,819 | 8/1965 | Widmark | 248/188.9 |
| 3,204,650 | 9/1965 | Shinew . | |
| 3,357,613 | 12/1967 | Chase | 224/209 X |
| 3,892,251 | 7/1975 | Warfield | 135/98 X |
| 4,188,965 | 2/1980 | Morman . | |
| 4,609,175 | 9/1986 | Conover . | |
| 4,760,610 | 8/1988 | Wu . | |
| 4,967,943 | 11/1990 | Massey | 224/251 X |
| 5,259,077 | 11/1993 | Hager et al. | 135/99 X |

FOREIGN PATENT DOCUMENTS 1069295 7/1954 France .

2213716 8/1989 United Kingdom .

*Primary Examiner*—Lanna Mai

*Attorney, Agent, or Firm*—Richard C. Litman

[57] ABSTRACT

An umbrella holster provides for the hands free support of an umbrella held thereby, with the umbrella being disposed to the front of the wearer of the holster to provide ready access for adjustment of the umbrella. The holster includes a waist belt and two back and shoulder straps, which straps secure to the umbrella support tube extending vertically upward from the front of the belt. The holster also provides for positive retention of the umbrella therein, to prevent the inadvertent lifting of the umbrella from the holster due to winds or other conditions, and for the height adjustment of the umbrella shaft by a telescoping umbrella handle and tube arrangement. The belt passes through a slot in the bottom of the main support tube, and is held therein by a cap on the end of the tube. While the two shoulder strap tube attachment ends are immovably fixed to the upper end of the support tube, the lower end of the second shoulder strap is free to slide along the belt for adjustment, and the arrangement provides for the lateral adjustment of the asymmetrical holster configuration, if desired. The assembly may be formed of a variety of materials, such as leather and/or plastic, and may include an umbrella in combination.

9 Claims, 1 Drawing Sheet

UMBRELLA HOLSTER

FIELD OF THE INVENTION

The present invention relates generally to accessories providing for the hands free carriage of an article, and more specifically to a holder or holster for an umbrella or the like, enabling the user thereof to support an opened umbrella thereby and enabling the user to have full use of both hands.

BACKGROUND OF THE INVENTION

Even with the advent of mechanization providing assistance in nearly all walks of life, it seems that pedestrians are carrying increasingly larger amounts of equipment, accessories, etc. to accompany them in their daily pursuits. It has become increasingly common to see persons carrying relatively large bags or the like, perhaps containing work related articles and books, shoes for wear in the office, lunch supplies, etc., etc., in their daily commutes. Indeed, it has become increasingly common to see such persons wearing back packs or the like in order to carry such goods. However, such back packs are not universally favored, even though they leave the hands free for other activities, due to the relative lack of access available without removing the pack.

Also, in both work related and leisure activities, portable music systems have become increasingly popular (e.g., the "boom box"), which devices are generally hand carried, as they generally are much too large to fit a pocket or the like due to the relatively large speakers provided.

The result of the above is a decreased ability for the typical person to hand carry any additional equipment or load, particularly an article which must be positioned properly about the person. When a sudden shower or rain occurs, it can be exasperating to say the least, to attempt to open and carry an umbrella or the like for protection, while at the same time continuing to hold the various articles of equipment being hand carried and refraining from dropping them in a puddle or otherwise allowing them to be dampened by the precipitation.

The need arises for a holder or holster which can be donned by a person and which provides for the support of an opened umbrella or the like above the person, all without need for any hand support by the person wearing the holster. The device must be relatively lightweight and comfortable, and provide for adjustment both of the length of the straps providing for securing to a person, and also for the height of the umbrella. The device must further provide means to secure the umbrella therein, to preclude the lifting removal of the umbrella from the support tube by the wind.

DESCRIPTION OF THE PRIOR ART

U.S. Pat. No. 1,460,821 issued to Thomas J. Morris on Jul. 3, 1923 discloses an Umbrella supported by a shoulder pad and a strap which passes beneath the opposite shoulder. The lower end of the frame holding the umbrella is unsecured and is free to move away from the body of the user in windy conditions, thus making the device less than fully effective. Moreover, the device comprises a combination of an umbrella and a holder therefor, rather than a separate holster for an umbrella. The umbrella and holder are secured to the back of the user, rather than the front.

U.S. Pat. No. 3,204,650 issued to Richard E. Shinew on Sep. 7, 1965 discloses an Umbrella including a hands-free holder therefor which secures to the user. The device requires two shoulder straps with a crossmember extending therebetween to hold the upper end of a tube providing for the support and storage of the umbrella. A second smaller tube supports the handle end of the umbrella and is insertable within the upper end of the larger tube, but no positive means is provided to preclude the lifting of the umbrella from the lower tube due to wind, as in the present invention, and no means for adjusting the height of the umbrella relative to the tube and the user is disclosed. The device is centered on the user's back, and thus cannot be worn to the front as the umbrella shaft would be directly in the face of the user.

U.S. Pat. No. 4,188,965 issued to John W. Morman on Feb. 19, 1980 discloses a Body Mounted Umbrella having a support shaft extending from a very wide waist belt worn by the user. The belt includes a rigid metal plate substantially the height of the belt and spanning nearly the entire width. While this arrangement provides cantilever support of the umbrella and shaft, it would be extremely uncomfortable to wear and would preclude any but the slightest changes in position by the wearer. It does not appear that the device would be wearable in a sitting position, for example. Again, the umbrella shaft must be to the rear, to avoid interference with the face of the user.

U.S. Pat. No. 4,609,175 issued to Lynn Conover on Sep. 2, 1986 discloses a Leg-Supported Umbrella Holder. The holder does not attach to the body by any means, but rather is held in place by the user clamping the device between his/her thighs while in a seated position; no straps or other attachment means are disclosed.

U.S. Pat. No. 4,760,610 issued to Bing T. Wu et al. on Aug. 2, 1988 discloses an Umbrella Cap Hat in the form of an enlarged baseball style cap when unfolded. The device secures to the head of the wearer by means of a conventional headband therein, with an additional vertical support resting upon the top of the wearer's head. No straps or bodily attachment means are disclosed, other than the headband and support discussed above.

French Patent No. 1,069,295 to Anna Durandeau, published on Jul. 6, 1954, discloses a holder for carrying an umbrella or the like, comprising two substantially vertical members having pins at each end, with the pins providing for attachment of the device to the clothing of the wearer. The vertical members include upper and lower fittings for securing an umbrella in place thereon. The device does not secure about the waist or over the shoulder of the wearer, but relies upon the pin attachment to the clothing. The risk of damage to the clothing is great, considering possible wind and other loads on the umbrella.

Finally, British Patent No. 2,213,716 to Tze-Bing Wu and published on Aug. 23, 1989 discloses an Umbrella Supported On The Head. The device is substantially similar to the device disclosed in U.S. Pat. No. 4,760,610 discussed above.

None of the above noted patents, taken either singly or in combination, are seen to disclose the specific arrangement of concepts disclosed by the present invention.

SUMMARY OF THE INVENTION

By the present invention, an improved umbrella holder or holster is disclosed.

Accordingly, one of the objects of the present invention is to provide an improved umbrella holster which uses an umbrella support tube as a portion of the system providing for the attachment of the apparatus to the wearer, in addition to serving as an umbrella support.

Another of the objects of the present invention is to provide an improved umbrella holster having an asymmetric configuration which shoulder straps extend only partially about the upper portion of the user's body to secure to the umbrella holder tube.

Yet another of the objects of the present invention is to provide an improved umbrella holster which provides for the positive retention of an umbrella therein, to preclude the inadvertent lifting of the umbrella from the holster due to winds or other conditions.

Still another of the objects of the present invention is to provide an improved umbrella holster in which an umbrella secured therein is disposed to the front of the user, thereby providing ready access and control of the umbrella without need of additional devices to provide control of a back mounted umbrella.

A further object of the present invention is to provide an improved umbrella holster which provides for the height adjustment of an umbrella secured therein.

An additional object of the present invention is to provide an improved umbrella holster which may be formed from a variety of materials, including leather and/or plastic, and which includes a novel means of securing tubular and flat components together.

Another object of the present invention is to provide an improved umbrella holster and umbrella combination.

A final object of the present invention is to provide an improved umbrella holster for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
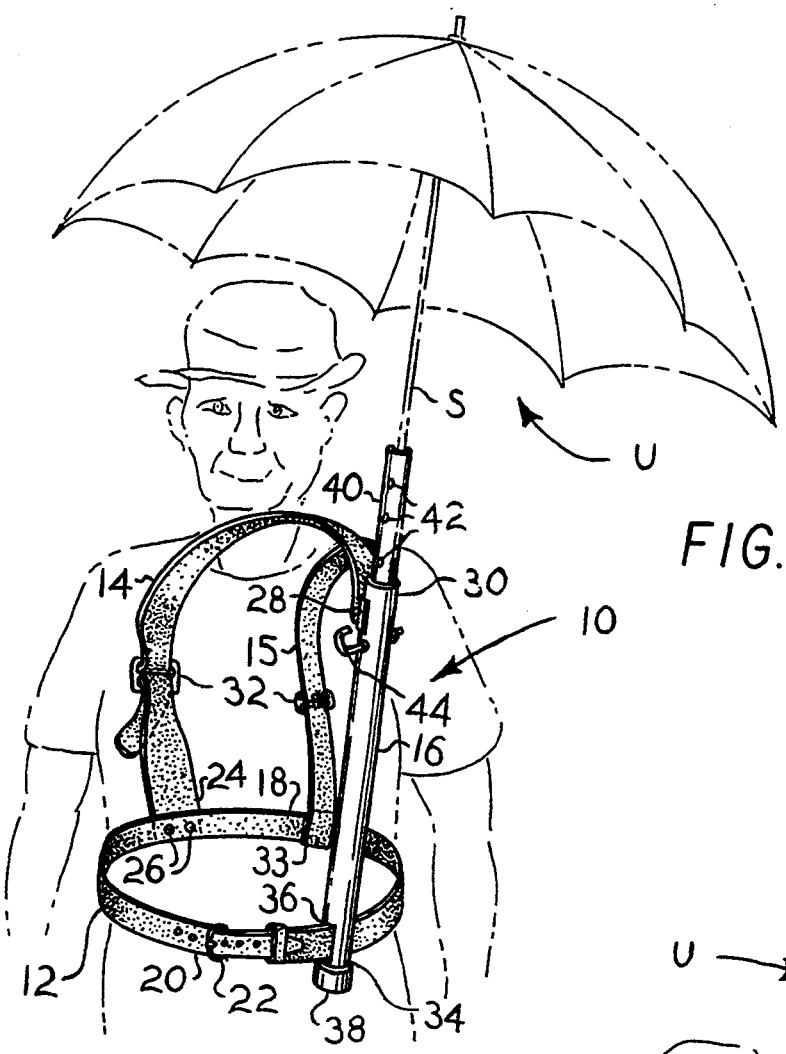
FIG. 1 is a front view of the umbrella holster of the present invention, showing an umbrella secured therein in an open position.

Referring now particularly to FIG. 1 of the drawings, the present invention will be seen to relate to an umbrella holster 10 providing for the hands free carriage of an umbrella U thereby. The holster 10 of the present invention generally comprises a waist belt 12, first and second back and shoulder straps 14 and 15, and a support tube 16. The belt 12, back/shoulder straps 14 and 15, and tube 16 are assembled together to form the present holster 10.

The waist belt 12 includes a back portion 18 and a front portion 20, with the front portion 20 including length adjusting means 22 (e.g., a buckle or the like). The first back/shoulder strap 14 includes a waist belt attachment end 24, which is secured asymmetrically to one side of the back portion 18 of the waist belt 12 by any suitable means (e.g., rivets 26), and an opposite support tube attachment end 28, also affixed to the upper end 30 of the support tube 16 by any suitable means. It will be seen that the back/shoulder straps 14 and 15 also include length adjusting means 32, in the manner of the waist belt 12, and that the first back/-shoulder strap 14 is somewhat wider than the waist belt 12, in order to distribute the load of the holster 10 and any umbrella U carried therein, to a greater degree. The second back/shoulder strap 15 is affixed to the upper end 30 of the tube 16 in a similar manner to that of the first back/shoulder strap, and includes a loop 33 around the rear portion 18 of the waist belt 12 to provide for lateral adjustment. The support tube 16 includes an opposite, lower end 34 which is affixed to the front portion 20 of the waist belt 12. The lower end 34 of the support tube 16 includes a slot 36 along the diameter thereof, through which the waist belt front portion 20 is passed. The waist belt 12 is prevented from slipping downward from the support tube slot 36 by a cap 38 affixed to the lower end 34 of support tube 16.

Vertical adjustability is provided for the umbrella U relative to the holster 10 by an umbrella handle 40, having an outside diameter at least slightly smaller than the inside diameter of the support tube 16. The handle 40 thus may telescope within the support tube 16, and be extended therefrom to provide for height adjustment of an umbrella U.

A series of handle passages 42 are formed across the diameter of the handle 40, and a cooperating pin 44 is passed laterally through the upper end 30 of the support tube 16. Thus, the height of the handle 40 may be adjusted as required by aligning the selected handle passages 42 with the support tube passage and inserting the tube securing pin 44 therethrough.

Most persons have experienced the effects of windy conditions on an opened umbrella, wherein the airflow over the curved upper surface of the umbrella creates a lifting force, akin to that created over an airfoil or wing, which lifts the umbrella upward. Gusty conditions, often accompanying a rain shower or the like, can also cause an umbrella to be lifted upwards suddenly. Such circumstances have been known to jerk an umbrella from the hand of a person holding it, possibly causing its loss. The present invention provides for positive retention of an umbrella U held therein, by means of the umbrella handle retaining pin 44 passing through both the upper end passage of the support tube 30 and the selected one of the plural umbrella handle passages 42.

Thus, the above invention will be seen to provide for the hands free support and carriage of an umbrella U thereby. Any standard umbrella having a straight handle 40 may be used in combination with the present holster 10. No modifications of the umbrella are required, with the exception of the plural handle passages 42 formed laterally through the handle 40 to provide for both positive retention of the umbrella U within the holster support tube 16 and for height adjustment of the umbrella U relative to the holster 10. Alternatively, a specially formed, modified umbrella handle may be provided, with the umbrella shaft S installed therein.

Figure 2:
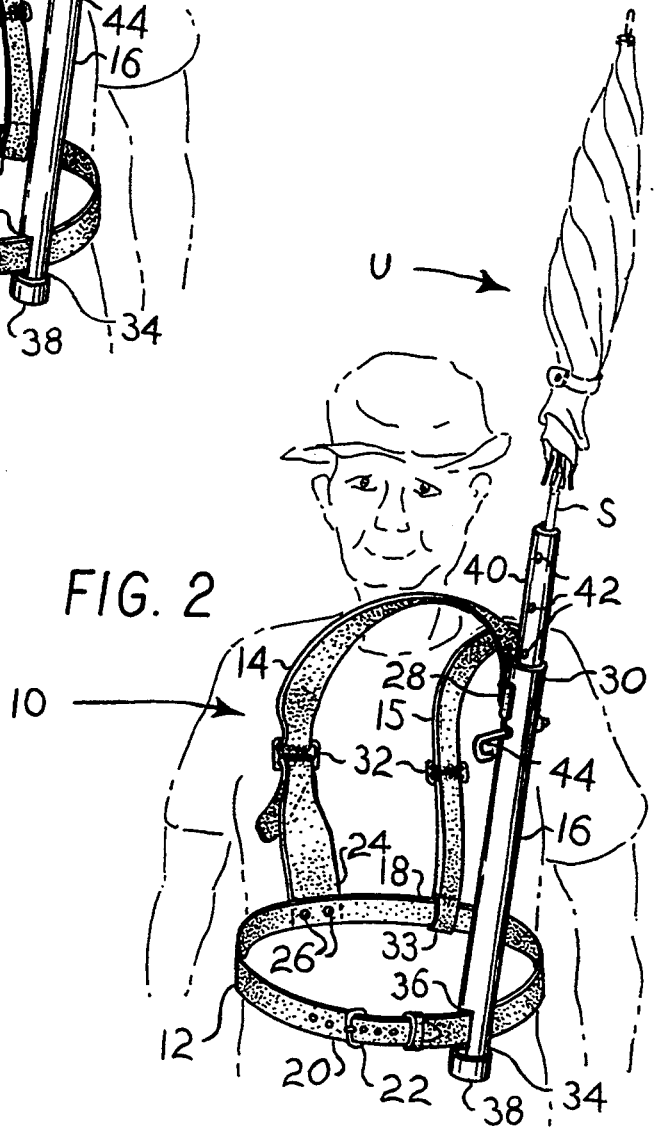
FIG. 2 is a front view of the umbrella holster of the present invention, showing an umbrella secured therein in a closed position.

The provision of the present holster for holding the umbrella U asymmetrically to the front of the user, enables the user to adjust, remove and replace the umbrella U readily, unlike other umbrella holders supporting an umbrella from behind the user. Thus, an umbrella U may be readily and easily raised to an open position, as shown in FIG. 1, or just as easily folded to a furled position, as shown in FIG. 2, without need for removal of the holster 10 and/or difficult contortions by the user of the holster 10 in order to reach the umbrella.

The present holster 10 lends itself to the use of a variety of materials. Preferably, for the sake of durability, strength, and appearance, the waist belt 12, first and second back/shoulder straps 14 and 15, and even the tube 16, are formed of leather or a leather-like material. The belt 12 and straps 14 and 15 may use relatively flexible material, while the tube is more suited to a stiffer, harder and more rigid material. Alternatively, a more economical version may be constructed using plastic pipe or tube (e.g., polyvinyl chloride, or PVC) for the support tube 16, if desired.

It is to be understood that the present invention is not limited to the sole embodiment described above, but encompasses any and all embodiments within the scope of the following claims.

I claim:

1. An umbrella holster comprising:

a waist belt including a front portion having length adjusting means and a back portion;

a first shoulder strap and a second shoulder strap, each having a waist belt attachment end secured to said back portion of said waist belt, a support tube attachment end, and length adjusting means therebetween, said second shoulder strap including lateral adjustment means at said waist belt attachment end; and a support tube including a lower end, an upper end, and means providing for the retention of an umbrella handle therein;

said support tube lower end including a slot and a cap installed over said support tube lower end, wherein said front portion of said waist belt passes through said slot and is secured therein by said cap, and said support tube upper end being secured to said tube attachment end of each said shoulder strap; wherein said support tube is positioned on the front portion of the waist belt adjacent said length adjustment means of said waist belt.

2. The umbrella holster of claim 1 wherein:

said means providing for the positive retention of an umbrella comprises at least one passage extending laterally across said support tube, and an umbrella retaining pin removably installed through said support tube passage, whereby;

said umbrella handle having at least one cooperating passage therethrough is positively retained by installing said umbrella retaining pin through said support tube passage and said umbrella handle cooperating passage.

3. The umbrella holster of claim 1 wherein:

said waist belt, said back and shoulder belt, and said support tube are formed of leather.

4. The umbrella holster of claim 1 wherein:

at least said support tube is formed of plastic.

5. An umbrella and umbrella holster therefor, comprising in combination:

an umbrella including a handle, a shaft extending therefrom, and a plurality of passages formed laterally across said umbrella handle;

an umbrella holster including a waist belt including a front portion having length adjusting means and a back portion;

a first shoulder strap and a second shoulder strap, each having a waist belt attachment end secured to said back portion of said waist belt, a support tube attachment end, and length adjusting means therebetween, said second shoulder strap including lateral adjustment means at said waist belt attachment end; and a support tube including a lower end, an upper end, means providing for the retention of an umbrella handle therein, and a passage extending laterally through said support tube, whereby an umbrella retaining pin removably installed through said support tube passage cooperates with a support tube passage of said umbrella handle to provide for a telescopically adjustable height of an umbrella held within said support tube;

said support tube lower being affixed to said front portion of said waist belt and extending substantially upward therefrom, and said support tube upper end being secured to said tube attachment end of each said shoulder strap; wherein said support tube is positioned on the front portion of the waist belt adjacent said length adjustment means of said waist belt.

6. The umbrella and umbrella holster combination of claim 5 wherein:

said support tube lower end of said umbrella holster includes a slot thereacross and a cap installed over said support tube lower end, and said waist belt of said umbrella holster passes through said slot of said support tube lower end and is secured therein by said cap.

7. The umbrella and umbrella holster combination of claim 5 wherein:

said waist belt, said back and shoulder belt, and said support tube of said umbrella holster are formed of leather.

8. The umbrella holster of claim 5 wherein:

said waist belt, said back and shoulder belt, and said support tube are formed of leather.

9. The umbrella and umbrella holster combination of claim 5 wherein:

at least said support tube of said umbrella holster is formed of plastic.

* * * * *